US008043107B2

(12) United States Patent
He

(10) Patent No.: US 8,043,107 B2
(45) Date of Patent: Oct. 25, 2011

(54) ELECTRICAL CONNECTOR

(75) Inventor: Hua He, Shanghai (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/774,149

(22) Filed: May 5, 2010

(65) Prior Publication Data

US 2010/0285694 A1 Nov. 11, 2010

(30) Foreign Application Priority Data

May 5, 2009 (CN) ..... 2009 2 0154839 U
May 5, 2009 (CN) ..... 2009 2 0154840 U
May 5, 2009 (CN) ..... 2009 2 0154841 U

(51) Int. Cl.
*H01R 13/627* (2006.01)

(52) U.S. Cl. ..... 439/352

(58) Field of Classification Search ..... 439/352, 439/353, 355, 488–489
See application file for complete search history.

(56) References Cited

U.S. PATENT DOCUMENTS 6,053,773 A * 4/2000 Wu ..... 439/607.08
6,113,428 A * 9/2000 Yeh ..... 439/607.17
6,213,813 B1 * 4/2001 Huang ..... 439/607.01
6,319,061 B1 * 11/2001 Chen et al. ..... 439/607.15
6,419,529 B1 * 7/2002 Shi et al. ..... 439/701
7,311,556 B2 * 12/2007 Wan et al. ..... 439/607.32
7,488,207 B2 * 2/2009 Zheng et al. ..... 439/541.5
2008/0026640 A1 * 1/2008 Zheng et al. ..... 439/626
2009/0305555 A1 * 12/2009 Wang et al. ..... 439/541.5

* cited by examiner

*Primary Examiner* — Jean Duverne
(74) *Attorney, Agent, or Firm* — Stephen L. Sheldon

(57) ABSTRACT

An electrical connector comprises a support body, first and second metal cases assembled with the support frame, and first and second terminal groups. The support frame comprises a first tongue part, a second tongue part, and a partition part which partitions the first and second tongue parts. The first terminal group is arranged in the first tongue part, and the second terminal group is arranged in the second tongue part. The support frame is sheltered with a metal sheltering casing comprising a front sheltering casing and a back sheltering casing which are assembled together. First and second holding plates extend from the first and second metal casings, the front sheltering casing is provided with notches, the support frame is provided with recesses, so that the first and second holding plates are held in the notches and recesses.

11 Claims, 9 Drawing Sheets

ELECTRICAL CONNECTOR

RELATED APPLICATIONS

This application claims priority to Chinese Application No. 200920154840.9, filed May 5, 2009, to Chinese Application No. 200920154839.5, filed May 5, 2009, and to Chinese Application No. 200920154841.2, filed May 5, 2009, all of which are incorporated herein by reference in their entirety.

TECHNICAL FIELD

The present invention relates to an electrical connector and, in particular, to a up-and-down stacked type of electrical connector.

BACKGROUND ART

U.S. Pat. No. 7,270,570 discloses a stacked connector, which comprises an insulating body, two tongue parts protruding forward from the insulating body, and a partition part for partitioning two tongue parts. A terminal group is provided on one of the two tongue parts respectively, and a metal casing assembled on the insulating body envelope the periphery of the two tongue parts, thus forming an upper connector and a lower connector. However, in this patent, there is no construction for fastening the metal casing of the upper connector and the insulating body, so that the upper connector tends to loose. Besides, there is no sheltering metal casing between two terminal groups for the purpose of shielding, so that cross-talking would easily occur between two terminal groups, which also affect the quality of signal transmission.

Therefore, the inventors think it is potential to improve the above issues, have studied diligently with the use of knowledge, and come up with the present invention which is reasonable in design and can effectively improve the above issues.

SUMMARY OF THE INVENTION

The present invention provides an electrical connector, comprising: an insulating support frame with a front side and an opposite back side; first and second metal casings assembled with the support frame and constituting first and second plugging spaces respectively; and first and second terminal groups connected with the support frame. The support frame comprises a first tongue part and a second tongue part which correspond to the direction of the front side. The support frame further comprises a partition part for partitioning the first tongue part from the second tongue part. The first tongue part is located over the partition part and into the first plugging space, the first terminal group is provided on the first tongue part, the second tongue part is located below the partition part and into the second plugging space, and the second terminal group is provided on the second tongue part. The support frame is sheltered with a metal sheltering casing which comprises a front sheltering casing and a back sheltering casing assembled together in the back and front direction. First holding plate bends and extends from the opposite sides of the first metal casing respectively, notch is provided on the opposite sides of the front sheltering casing respectively, and the first holding plates are correspondingly held in the notches of the front sheltering casing. Second holding plate bends and extends from the opposite sides of the second metal casing respectively, recess is provided on the opposite sides of the support body respectively, and the second holding plates are correspondingly held in the recesses of the support frame.

Preferably, at least a first elastic plate and at least a second elastic plate bend and extend from the opposite top and bottom of the front sheltering casing, the first elastic plate tightly presses against the bottom of the first metal casing, and the second elastic plate tightly presses against the top of the second metal casing.

To further understand the features and technical aspects of the present invention, reference is made to the detailed description and the accompanying drawings of the present invention. However, the accompanying drawings are not used for limiting the present invention, but providing reference and description.

DETAILED DESCRIPTION OF THE PREFERRED EMBODIMENTS

A main object of the present invention is to provide an electrical connector which can be secured firmly without tendency of loosing. A further object of the present invention is to provide an electrical connector which can not only be secured firmly, but also reduce the probability of occurring cross-talking.

To achieve the further object mentioned above, the metal sheltering casing is grounded, so that the first and second metal casings are also grounded via the first and second elastic plates. The present invention has the following beneficial effects:

First holding plates on both sides of the first metal casing are correspondingly held in the notches of the front sheltering casing, and second holding plates on both sides of the second metal casing are correspondingly held in the recesses of the support frame, so that the first and second metal casings can be secured firmly to the front sheltering casing and the support frame without tendency of loosing.

By pressing the first and second elastic plates against the first and second metal casings, these two metal casings can be secured more firmly. Furthermore, when the metal sheltering casing is grounded, the first and second metal casings can also be grounded, so that the first and second metal casings can not only provide the effect of preventing EMI, but also reduce the cross-talking between the first and second terminal groups.

As shown in FIGS. 1-4, the present invention provides an electrical connector, which comprises an insulating support frame 1, a first terminal group 2*a*, a second terminal group 2*b*, a first metal casing 3*a*, a second metal casing 3*b*, and a metal sheltering casing 4.

Figure 3:
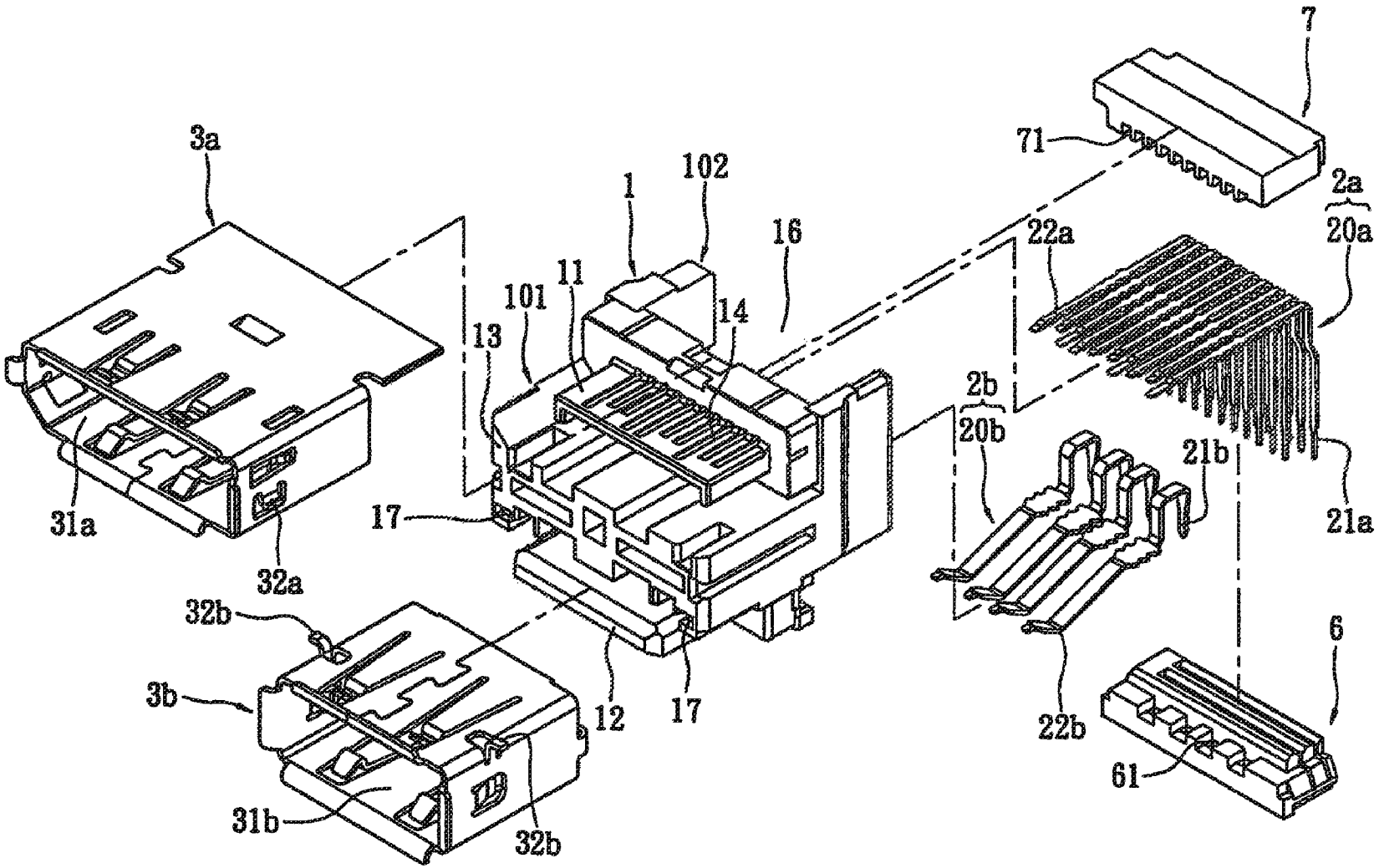
FIG. 3 is an exploded perspective view showing the electrical connector of the present invention, in which a metal sheltering casing and a circuit board are removed.
Figure 4:
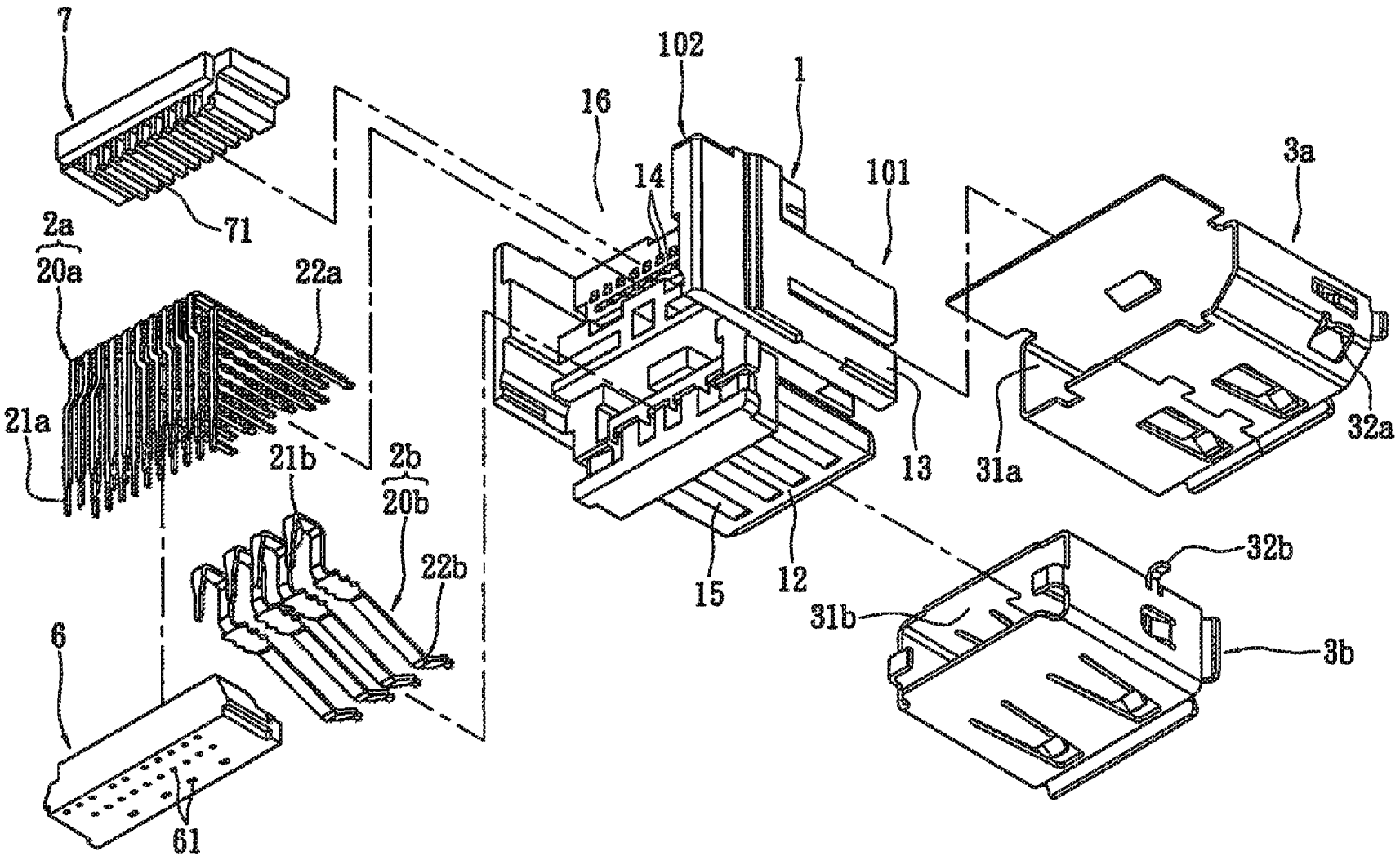
FIG. 4 is an exploded perspective view showing the electrical connector of the present invention in another angle of view, in which a metal sheltering casing and a circuit board are removed.

The support frame 1 has a front side 101 and an opposite back side 102. The support frame 1 comprises a first tongue part 11 and a second tongue part 12 which correspond to the direction of the front side 101, and further comprises a partition part 13 for partitioning the first tongue part 11 from the second tongue part 12. The first tongue part 11 lies above the partition part 13, and the second tongue part 12 lies below the partition part 13. The first tongue part 11 can be recessed to form a plurality of first terminal grooves 14 on the opposite upper and lower tongue surfaces thereof, respectively, and the second tongue part 12 is recessed to form a plurality of second terminal grooves 15 on the lower tongue surface thereof (as shown in FIG. 4). The support frame 1 is further recessed to form an accommodating chamber 16 on the back side 102 of the first tongue part 11 and the second tongue part 12 (as shown in FIG. 3).

The first terminal group 2*a* is composed of a plurality of first terminals 20*a*. Each of the first terminal 20*a* comprises a first soldering pin 21*a* and a first contacting part 22*a* bending and extending from the top of the first soldering pin 21*a*.

The second terminal group 2*b* is composed of a plurality of second terminals 20*b*. Each of the second terminal 20*b* comprises a second soldering pin 21*b* and a second contacting part 22*b* extending from the top of the second soldering pin 21*b*.

The first terminal group 2*a* is arranged on the first tongue part 11 of the support frame 1, so that the first contacting part 22*a* is accommodated into the first terminal grooves 14 correspondingly in the upper and lower tongue surfaces of the first tongue part 11, while the first soldering pin 21*a* extends out of the back side 102 of the first tongue part 11 and enters into the accommodating chamber 16. However, the arrangement of the first contacting part 22*a* of the first terminal group 2*a* is not limited to the described embodiment, and variations are possible. For example, the first contacting part 22*a* can be arranged in one of the tongue surfaces of the first tongue part 11.

The second terminal group 2*b* is arranged on the second tongue part 12 of the support frame 1, so that the second contacting part 22*b* of the second terminal 20*b* is correspondingly arranged into the second terminal groove 15 of the second tongue part 12, and the second soldering pin 21*b* extends out of the back side of the second tongue part 12 and enters into the accommodating chamber 16.

The first metal casing 3*a* and the second metal casing 3*b* are arranged oppositely on the upper and lower side of the support body 1. The first metal casing 3*a* constitutes a first plugging space 31*a*, in which the first tongue part 11 and the first contacting part 22*a* of the first terminal group 2*a* are accommodated. The second metal casing 3*b* constitutes a second plugging space 31*b*, in which the second tongue part 12 and the second contacting part 22*b* of the second terminal group 2*b* are accommodated.

Figure 5:
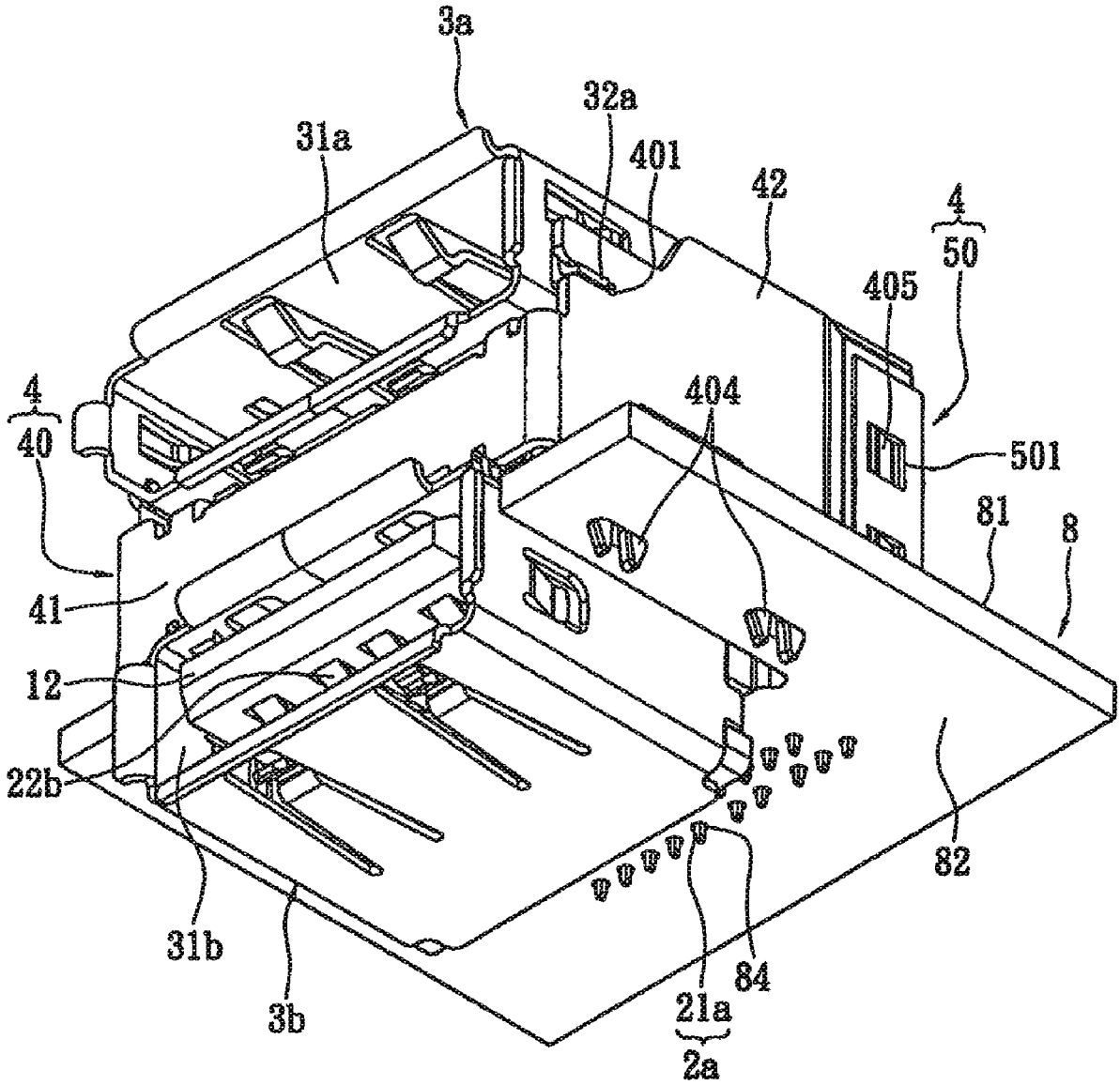
FIG. 5 is a perspective view showing the electrical connector of the present invention which is arranged on a circuit board.
Figure 6:
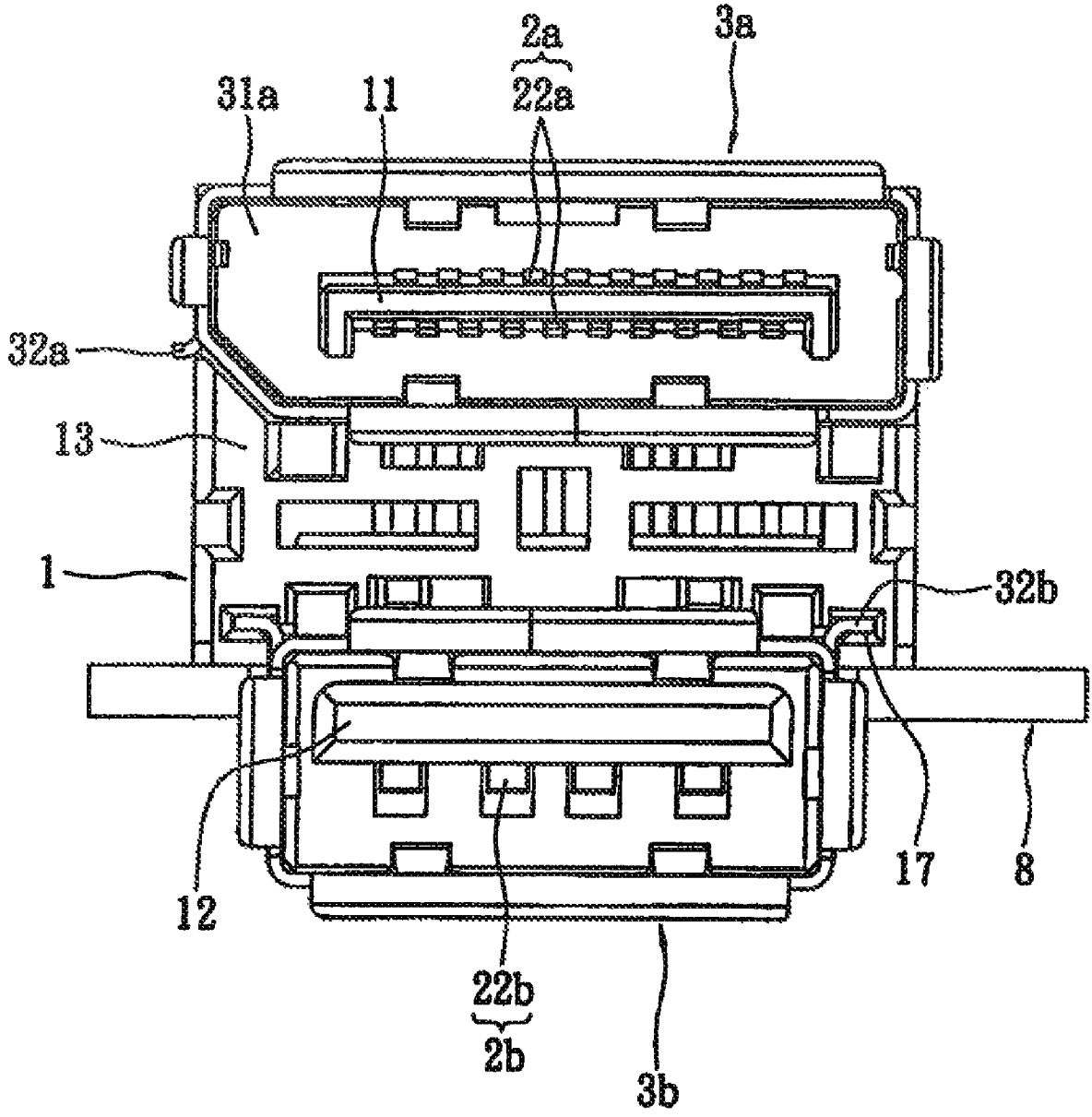
FIG. 6 is a front view showing the electrical connector of the present invention which is arranged on a circuit board after a metal sheltering casing is removed.

The metal sheltering casing 4 shelters the support body 1 with a front sheltering casing 40 and a back sheltering casing 50 which are assembled together in the back and front direction. According to the present invention, a first holding plate 32*a* bends and extends from the opposite sides of the first metal casing 3*a* respectively, notch 401 is recessed on the opposite sides of the front sheltering casing 40 respectively, a second holding plate 32*b* bends and extends from the opposite sides of the second metal casing 3*b* respectively, and a recess 17 is provided on the opposite sides of the support frame 1 respectively. The first holding plates 32*a* on both sides of the first metal casing 3*a* are correspondingly held in the notches 401 of the front sheltering casing 40 (as shown in FIG. 5), the second holding plates 32*b* on both sides of the second metal casing 3*b* are correspondingly held in the recesses 17 of the support frame 1 (as shown in FIG. 6). In this way, the first metal casing 3*a* and the second metal casing 3*b* can be secured firmly to the front sheltering casing 40 and the support frame 1, and it is not easy to loose. In particular, the front sheltering casing 40 shelters the partition part 13 of the support frame 1, while the back sheltering casing 50 shelters the back side 102 of the support frame 1, to shield the first soldering pin 21*a* of the first terminal group 2*a* and the second soldering pin 21*b* of the second terminal group 2*b*. In addition, a snap part 405 is provided on the opposite sides of the front sheltering casing 40 respectively, while a snap hole 501 is provided on the opposite sides of the back sheltering casing 50 respectively. The snap part 405 is correspondingly fastened to the snap hole 501, so that the front sheltering casing 40 and the back sheltering casing 50 can be assembled with each other.

Figure 7:
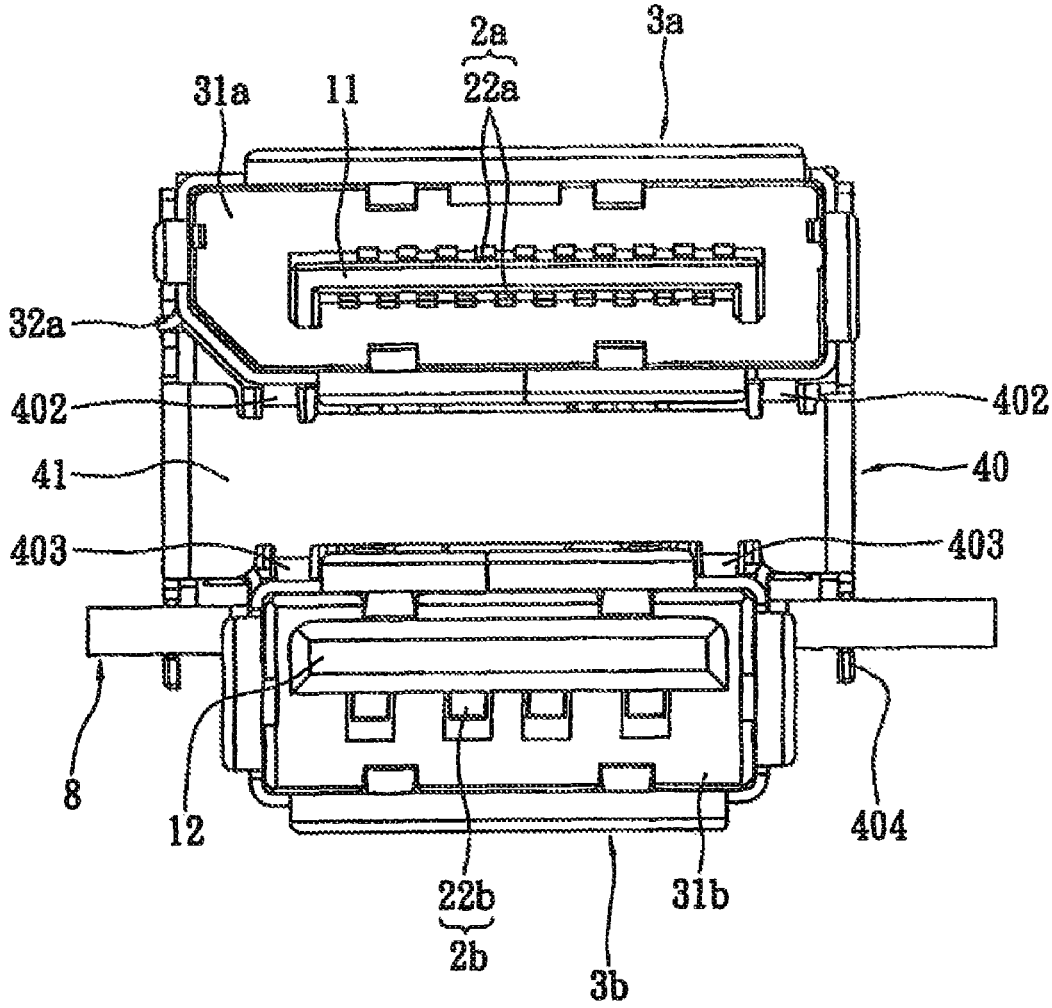
FIG. 7 is a front view showing the electrical connector of the present invention which is arranged on a circuit board.

In addition, according to the present invention, at least a first elastic plate 402 and at least a second elastic plate 403 can be provided, which bend and extend from the opposite top and bottom of the front sheltering casing 40. The first elastic plate 402 can elastically and tightly press against the bottom of the first metal casing 3*a*, the second elastic plate 403 can elastically and tightly press against the top of the second metal casing 3*b* (as shown in FIG. 7), which in turn results in that the first and second metal casing 3*a*, 3*b* can be secured more firmly without tendency of loosing.

As described above, the electrical connector according to the present invention is adapted to a circuit board 8. The circuit board 8 is provided with opposite upper and lower board surface 81, 82, and a placing groove 83 penetrating through the upper and lower board surface 81, 82. The circuit board 8 is further provided with a plurality of first and second soldering holes 84, 85 penetrating the upper and lower board surface 81, 82. Here, the second metal casing 3*b* is correspondingly positioned in the placing groove 83, so that the electrical connector is sunk in the circuit board 8, and the first and second soldering pins 21*a*, 21*b* pass through the corresponding first and second soldering holes 84, 85 and are soldered with the circuit board 8 by solders to achieve electrical conduction. By providing the metal sheltering casing 4 between the first terminal group 2*a* and the second terminal group 2*b*, it is possible to reduce the cross-talking between the first terminal group 2*a* and the second terminal group 2*b*.

Here, fixing members 404 extends downwardly from the bottom of two opposite sides of the metal sheltering casing 4, for connecting with the corresponding fixing part 86 of the circuit board 8. Preferably, the fixing part 86 of the circuit board 8 is electrically grounded, so that the front sheltering casing 40 is also electrically grounded. As a result, when the metal sheltering casing 4 is grounded, by pressing the first elastic plate 402 and the second elastic plate 403 tightly against the first metal casing 3*a* and the second metal casing 3*b*, it is possible to not only make the first metal casing 3*a* and the second metal casing 3*b* more stable, but also make the first and second metal casing 3*a*, 3*b* to be connected with the ground. In this way, in addition to the effect of preventing EMI, the first and second metal casing 3*a*, 3*b* can also reduce the cross-talking between the first terminal group 2*a* and the second terminal group 2*b*.

Figure 8:
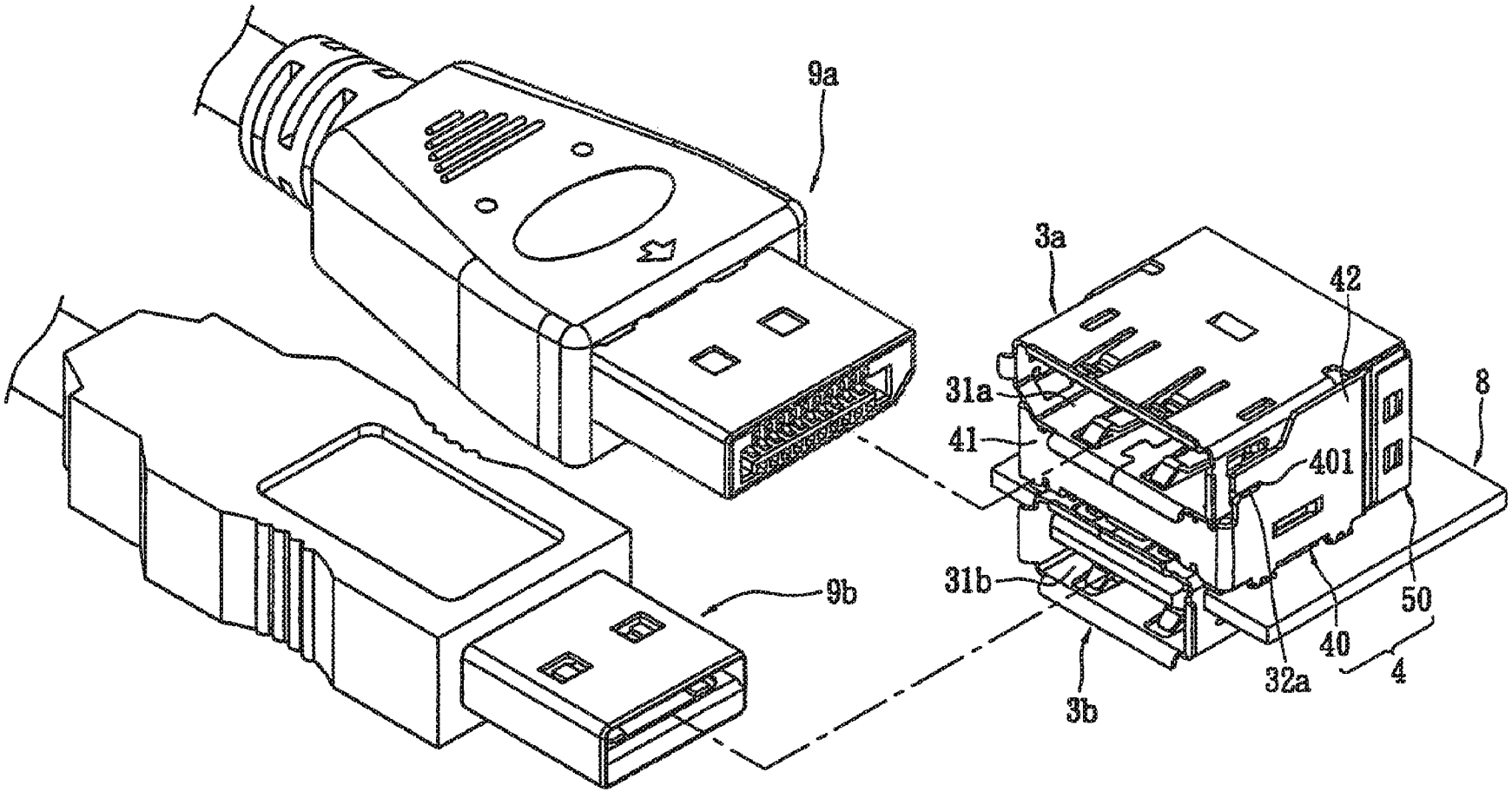
FIG. 8 is an exploded perspective view showing the electrical connector of the present invention which is plugged with a plug connector.

As shown in FIG. 8, the electrical connector of the present invention can be plugged with two plug connectors 9*a*, 9*b* of different specifications, which can be correspondingly inserted into the first plugging space 31*a* and second plugging space 31*b*, to contact correspondingly with the first contacting part 22*a* of the first terminal group 2*a* and the second contacting part 22*b* of the second terminal group 2*b* so as to achieve the signal transmission.

In the particular embodiments of the present invention, the front sheltering casing 40 comprises a front board portion 41 and two side board portions 42 connected at the opposite sides of the front board portion 41. The front board portion 41 shelters the front wall of the partition part 13, and the side board portions 42 shelter two opposite side walls of the partition part 13. The first and second elastic plate 402, 403 bend and extend from the top and bottom of the front board portion 41, the notches 401 are provided on the top of two side board portions 42, and the snap part 405 described above is provided on the back end of two side board portions 42. The snap part 405 can be an elastic sheet which is formed by punching the side board portion 42, although it is not limited to this. In addition, the fixing member 404 extends downwardly from the bottom of two opposite sides of the front sheltering casing 40 and, in particular, from the bottom of the side board portion 42. The fixing member 404 may be a snap member, and the fixing part 86 of the circuit board 8 may be a grounding hole which matches with the snap member and allows the snap member to pass through, although it is not limited to this. The fixing member may also be a bending sheet which extends downwardly, and the fixing part may be a matching pad. Besides, two side board portions 42 of the front sheltering casing 40 can also shelter the opposite sides of the first metal casing 3*a*, so as to shelter the first metal casing 3*a* to improve its stability and prevent loosing.

Figure 1:
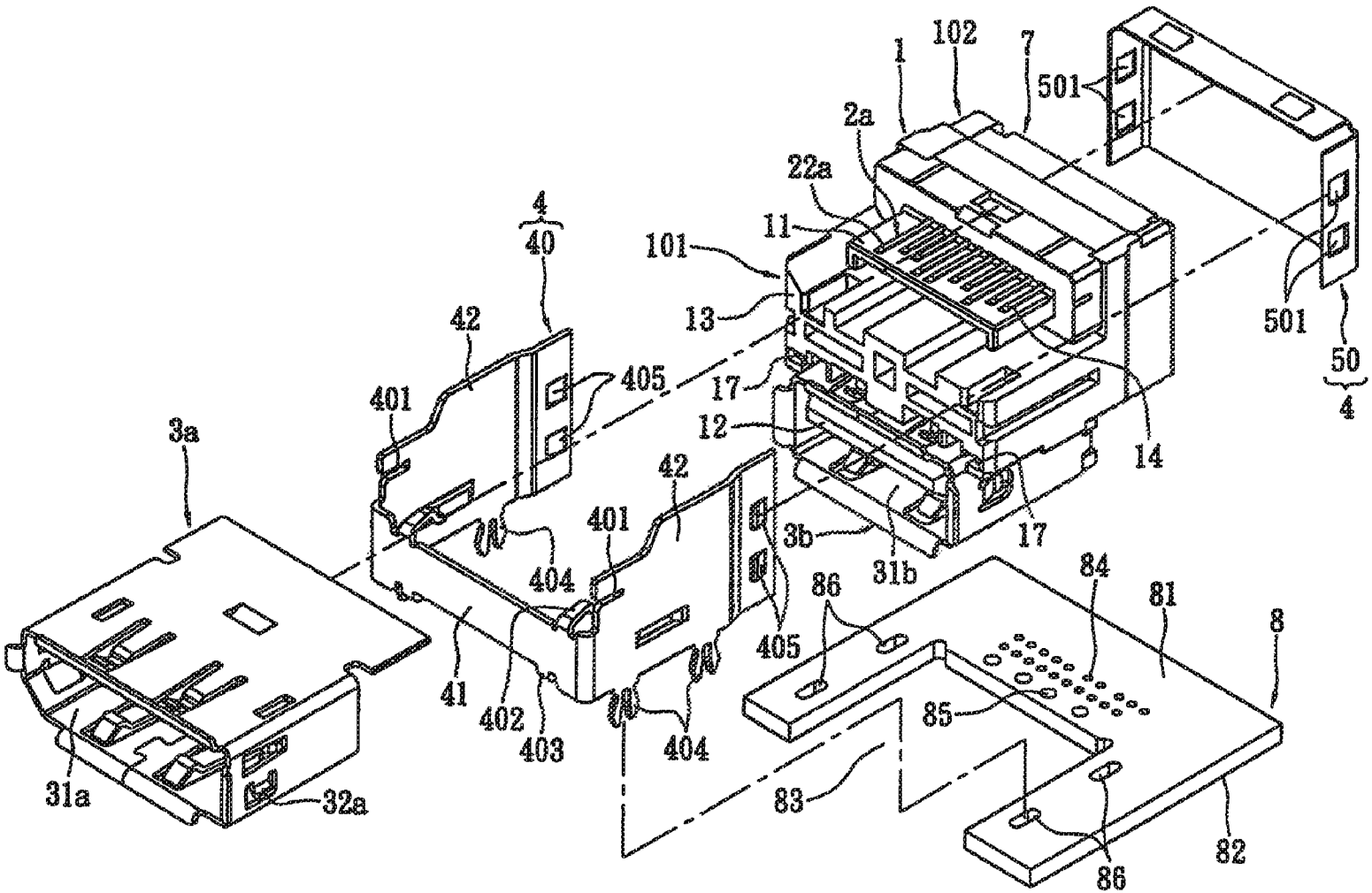
FIG. 1 is a partially exploded perspective view showing the electrical connector of the present invention.
Figure 2:
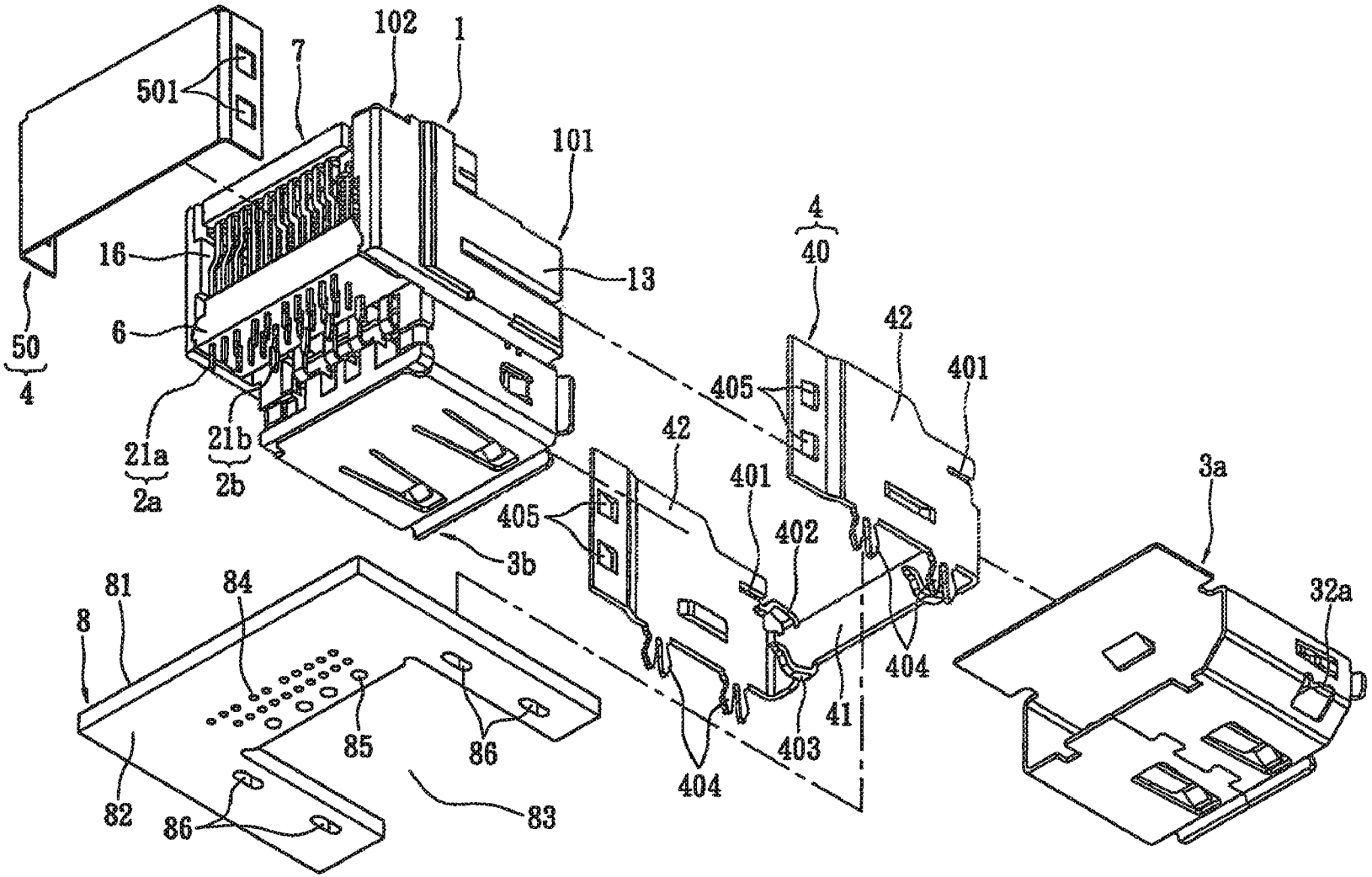
FIG. 2 is a partially exploded perspective view showing the electrical connector of the present invention in another angle of view.
Figure 9:
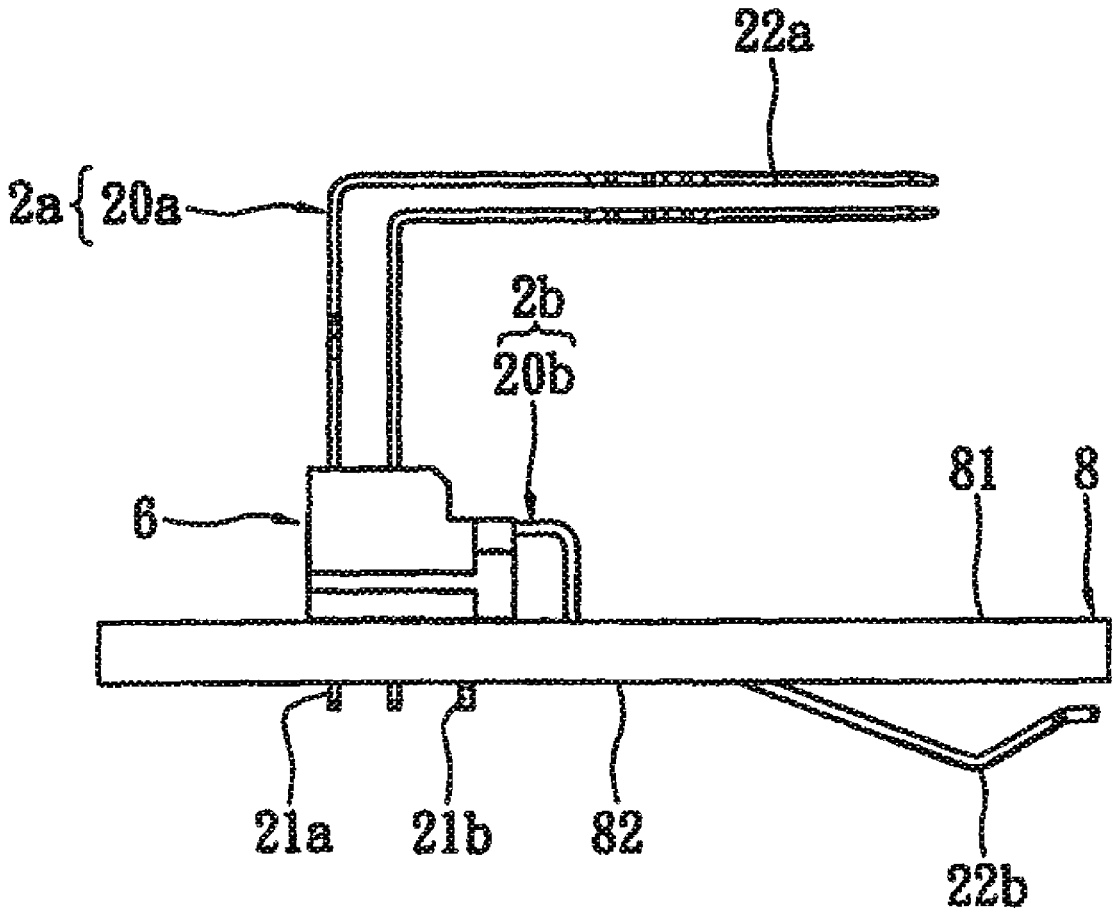
FIG. 9 is a side view of the electrical connector of the present invention arranged on a circuit board, which shows the relation between the circuit board and a first terminal group, a second terminal group, and a terminal positioning member.

Furthermore, the electrical connector according to the present invention can further comprise a terminal positioning member 6, which is provided with a plurality of terminal positioning holes 61. The terminal positioning member 6 is clamped into the accommodating chamber 16 at the back side 102 of the support frame 1, and the first and second soldering pins 21*a*, 21*b* of the first and second terminal groups 2*a*, 2*b* are plugged into the corresponding terminal positioning holes 61, with ends thereof extending out of the terminal positioning holes 61 to be soldered with the circuit board 8. As shown in FIG. 9, the terminal positioning member 6 is located on the upper board surface 81 of the circuit board 8, through which the soldering pins of two terminal groups are held. Besides, as shown in FIG. 9, the first contacting part 22*a* of the first terminal group 2*a* extends from the first soldering pin 21*a* over the upper board surface 81 and can be arranged on the first tongue part 11 (as shown in FIG. 1) and over the upper board surface 81 of the circuit board 8, while the second contacting part 22*b* of the second terminal group 2*b* extends from the second soldering pin 21*b* over the upper board surface 81 and can be arranged on the second tongue part 12 (as shown in FIG. 5) and below the lower board surface 82 of the circuit board 8.

In addition, the electrical connector can further comprise a terminal holding base 7, which is provided with a plurality of positioning recesses 71. The terminal holding base 7 is fixed into the accommodating chamber 16 at the back side 102 of the support frame 1, and are held over the terminal positioning member 6, while the ends of the first contacting parts 22*a* of the first terminal group 2*a* near the first soldering pins 21*a* are located into the corresponding positioning recesses 71, so as to position the first terminal group 2*a*.

As described above, according to the present invention, the first holding plates 32*a* on both sides of the first metal casing 3*a* are fastened into the corresponding notches 401 of the front sheltering casing 40, and the second holding plates 32*b* on both sides of the second metal casing 3*b* are fastened into the corresponding recesses 17 of the support frame 1, so that the first and second metal casing 3*a*, 3*b* can be secured firmly to the front sheltering casing 40 and the support frame 1 without tendency of loosing.

Moreover, by pressing the first and second elastic plates 402, 403 of the metal sheltering casing 4 against the first and second metal casing 3*a*, 3*b*, the first and second metal casing 3*a*, 3*b* can be secured more firmly. In addition, once the metal sheltering casing 4 is grounded, the first and second metal casing 3*a*, 3*b* are also grounded. In this case, the two metal casing can not only provide the effect of preventing EMI, but also reduce the cross-talking between the first and second terminal groups 2*a*, 2*b*.

The embodiments described above are only preferred embodiments according to the invention, and not intend to limit the protection scope of the present invention. It should be noted that all equivalent structural variations according to the description and drawings of the present invention fall within the protection scope of the present invention.

What is claimed is:

1. An electrical connector, comprising:

an insulating support frame, first and second metal casings assembled with the support frame and constituting first and second plugging spaces respectively, and first and second terminal groups;

the support frame comprising a first tongue part, a second tongue part, and a partition part which partitions the first tongue part from the second tongue part;

the first tongue part being located over the partition part and into the first plugging space of the first metal casing, the second tongue part being located below the partition part and into the second plugging space of the second metal casing;

the first terminal group being arranged on the first tongue part, and the second terminal group being arranged on the second tongue part;

wherein the support frame is sheltered with a metal sheltering casing which comprises a front sheltering casing and a back sheltering casing assembled together in a back and front direction, a first holding plate bends and extends from opposite sides of the first metal casing respectively, a notch is recessed on opposite sides of the front sheltering casing respectively, and the first holding plates are correspondingly held in the notches of the front sheltering casing, and a second holding plate bends and extends from opposite sides of the second metal casing respectively, a recess is provided on opposite sides of the support frame respectively, and the second holding plates are correspondingly held in the recesses of the support frame, wherein at least a first elastic plate and at least a second elastic plate bend and extend from opposite a top and bottom of the front sheltering casing, wherein the first elastic plate tightly presses against a bottom of the first metal casing, and the second elastic plate tightly presses against a top of the second metal casing.

2. The electrical connector according to claim 1, wherein the front sheltering casing shelters the partition part of the support frame, and the back sheltering casing shelters a back side of the support frame.

3. The electrical connector according to claim 2, wherein the front sheltering casing comprises a front board portion and two side board portions connected at opposite sides of the front board portion, the front board portion shelters a front wall of the partition part of the support frame, the two side board portions shelter opposite side walls of the partition part;

a snap part is provided at back end of two side board portions respectively, and a snap hole is provided on opposite sides of the back sheltering casing respectively, the snap part is correspondingly fastened into the snap hole.

4. The electrical connector according to claim 1, wherein a fixing member extends downwardly from bottom of opposite sides of the metal sheltering casing.

5. The electrical connector according to claim 4, wherein the fixing member is connected to a fixing part of a circuit board.

6. The electrical connector according to claim 4, wherein the front sheltering casing comprises a front board portion and two side board portions connected at opposite sides of the front board portion, and the fixing member extends downwardly from bottom of both side board portions of the front sheltering casing.

7. The electrical connector according to claim 1, wherein the front sheltering casing comprises a front board portion and two side board portions connected at opposite sides of the front board portion, the front board portion shelters front wall of the partition part of the support frame, the two side board portions shelter opposite side walls of the partition part; and the first elastic plate and the second elastic plate bend and extend from the opposite top and bottom of the front board portion oppositely.

8. The electrical connector according to claim 7, wherein the two side board portions of the front sheltering casing shelter the opposite sides of the first metal casing.

9. The electrical connector according to claim 7, wherein the front sheltering casing is electrically grounded.

10. The electrical connector according to claim 7, wherein a fixing member extends downwardly from the bottom of opposite sides of the metal sheltering casing, and the fixing member is connected with a fixing part of a circuit board, wherein the fixing part is electrically grounded.

11. The electrical connector according to claim 7, wherein a fixing member extends downwardly from bottom of two side board portions of the front sheltering casing, and the fixing member is connected to a fixing part of a circuit board, wherein the fixing part is electrically grounded.

* * * * *